US009304528B2

(12) United States Patent
Huang

(10) Patent No.: US 9,304,528 B2
(45) Date of Patent: Apr. 5, 2016

(54) REFERENCE VOLTAGE GENERATOR WITH OP-AMP BUFFER

(71) Applicant: Taiwan Semiconductor Manufacturing Co., Ltd., Hsin-Chu (TW)

(72) Inventor: Char-Ming Huang, Miaoli (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 281 days.

(21) Appl. No.: 13/837,464

(22) Filed: Mar. 15, 2013

(65) Prior Publication Data

US 2014/0152290 A1 Jun. 5, 2014

Related U.S. Application Data

(60) Provisional application No. 61/733,166, filed on Dec. 4, 2012.

(51) Int. Cl.
*G05F 3/16* (2006.01)
*G05F 3/30* (2006.01)

(52) U.S. Cl.
CPC ..... *G05F 3/30* (2013.01)

(58) Field of Classification Search
CPC ..... G05F 3/30; G05F 3/267; G05F 1/463; G05F 3/225; G05F 3/245; G05F 1/46
USPC ..... 323/313–317
See application file for complete search history.

(56) References Cited

U.S. PATENT DOCUMENTS

2008/0224682 A1* 9/2008 Haiplik ..... 323/313

OTHER PUBLICATIONS

Tony R. Kuphaldt. Lessons in Electric Circuits. Oct. 2007. vol. 3. Online. http://www.ibiblio.org/kuphaldt/electricCircuits/Semi/SEMI_8.html, pp. 1-40.*

* cited by examiner

*Primary Examiner* — Harry Behm
*Assistant Examiner* — Peter Novak
(74) *Attorney, Agent, or Firm* — Duane Morris LLP

(57) ABSTRACT

A reference voltage circuit and method making same, the reference voltage circuit including: a first sub-circuit for generating first and second temperature-compensated voltages; a second sub-circuit configured to receive the first and second temperature-compensated voltages and generate first and second reference voltages based on the first and second temperature-compensated voltages, respectively; and a third sub-circuit configured to receive and change voltage levels of the first and second reference voltages, and output a third reference voltage.

20 Claims, 3 Drawing Sheets

R5=R6=60K R3=1K
R1=R2=6K, R7=R8=2K, R10=R9=40K

| | |
|---|---|
| R5=R6=60K | R3=1K |
| R1=R2=6K, R7=R8=2K, R10=R9=40K | |

| | Another BG | Disclosed BG |
|---|---|---|
| Temp | -25~125oC | -25 ~125 oC |
| supply voltage | 1.8 V | 1.8 V |
| The standard variation of the Vref accuracy | 2.10% | 0.80% |
| The standard variation of the TCF | 30ppm | 10ppm |
| Circuit total current | 300uA | 600uA |
| Total value of the resistance | 164K ohm | 217K ohm |
| The width/length of the MOS | W=0.8um; L=2um | W=0.8um; L=2um |
| The multi finger of the total MOS of the BG | F=460 | F=860 |

FIG.2

REFERENCE VOLTAGE GENERATOR WITH OP-AMP BUFFER

CROSS REFERENCE TO RELATED APPLICATIONS

This application claims priority to U.S. Provisional Patent Application No. 61/733,166 filed on Dec. 4, 2012, the contents of which are incorporated by reference herein in its entirety.

TECHNICAL FIELD

The present disclosure relates generally to integrated circuit (IC) designs, and more particularly to a reference voltage circuit.

BACKGROUND

The increase in demand for portable devices and technology scaling are driving down the supply voltages of digital circuits. A voltage reference generator is used in many integrated circuits (ICs). The bandgap reference generator which can operate from a 1V supply is widely used, for example, in DRAM and flash memories. A bandgap voltage reference should be insensitive to temperature, power supply and load variations.

One principle of operation of bandgap circuits relies on two groups of diode-connected bipolar junction transistors (BJT) running at different emitter current densities. By canceling the negative temperature dependence of the PN junctions in one group of transistors with the positive temperature dependence from a PTAT (proportional-to-absolute-temperature) circuit which includes the other group of transistors, a fixed DC voltage output, Vref, which doesn't substantially change with temperature is generated. This reference voltage is typically 1.26 volts, which is approximately equal to the bandgap voltage of silicon.

Recent IC designs sometimes require sub-1 volt operation regions. Additionally, for integrated circuits used in thermal sensors or three-dimensional (3-D) IC applications, for example, it is desirable to have a very small temperature coefficient bandgap reference voltage in order to sense temperature variations. Some bandgap reference circuits, however, can become unstable or lose accuracy as a result of variation in input offset voltages applied to an operational amplifier of the bandgap reference circuit and/or current mirror mismatch effects. However, at low input offset voltages applied to the operational amplifier, the current mirror mismatch effect will dominate and can degrade the accuracy and performance of such bandgap reference circuits.

BRIEF DESCRIPTION OF THE DRAWING

The present disclosure is best understood from the following detailed description when read in conjunction with the accompanying drawings. It is emphasized that, according to common practice, the various features of the drawings are not necessarily to scale. On the contrary, the dimensions of the various features may be arbitrarily enlarged or reduced for clarity or emphasis. Like numerals denote like features throughout the specification and drawings.

FIG. 2 illustrates a table that shows a comparison of various operating parameters of another bandgap reference circuit when compared to an exemplary bandgap reference circuit in accordance with an embodiment of the disclosure.

DETAILED DESCRIPTION OF EXEMPLARY EMBODIMENTS

Exemplary embodiments of the disclosure are described in detail below with reference to the figures As would be apparent to one of ordinary skill in the art after reading this description, these embodiments are merely exemplary and the disclosure is not limited to these examples. It is to be understood that other embodiments may be utilized and structural changes may be made without departing from the scope of the present disclosure.

Figure 1:
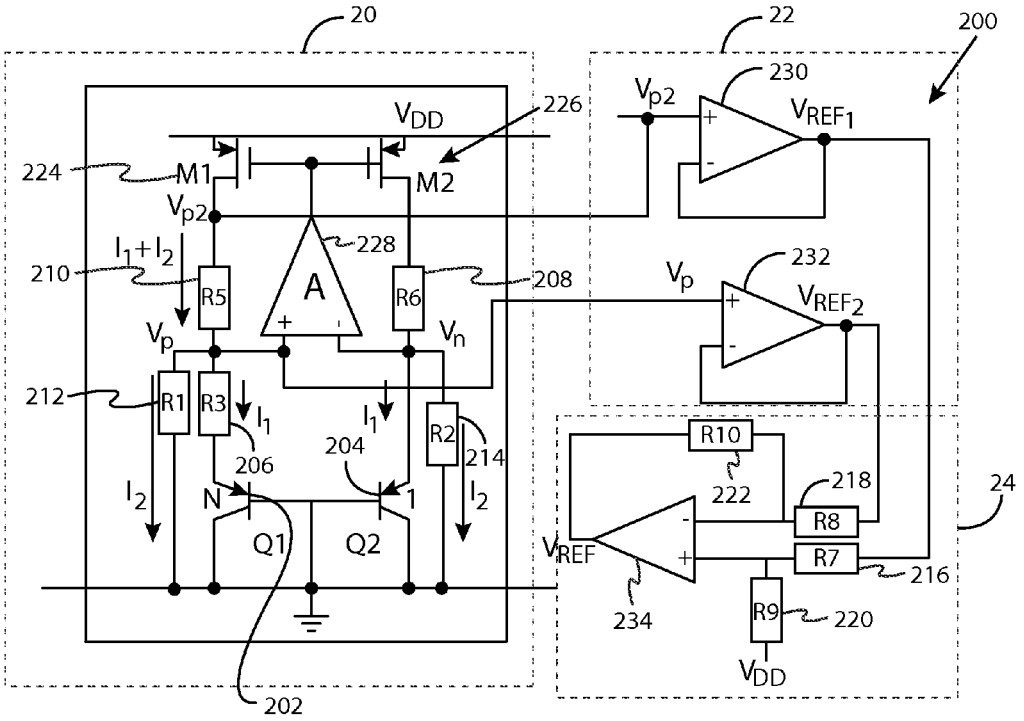
FIG. 1 illustrates a simplified schematic diagram of a bandgap reference circuit without a current a mirror, in accordance an embodiment of the disclosure.

FIG. 1 illustrates a bandgap reference voltage circuit 200, which does not have a current mirror, in accordance with an embodiment of the disclosure. As shown in FIG. 1, the bandgap reference circuit 200 includes three sub-circuits 20, 22 and 24. The first sub-circuit 20 includes two bipolar transistors 202 and 204, five resistive devices 206, 208, 210, 212 and 214, two MOSFET transistors 224 and 226, and a first differential amplifier 228. The second sub-circuit 22 includes two differential amplifiers 230 and 232. The third sub-circuit 24 includes four resistive devices 216, 218, 220 and 222, and a fourth differential amplifier 234. The functionality of each of the sub-circuits 20, 22 and 24 are described generally below, followed by a more detailed, component-level discussion of the operation of the bandgap reference circuit 200.

In one embodiment, the first sub-circuit generally operates in a current mode to provide temperature compensated reference currents through resistive devices 206, 208, 210, 212 and 214, bipolar transistors 202 and 204 and MOSFET transistors 224 and 226. As shown in FIG. 1, the temperature-compensated reference currents $I_1$ and $I_2$ generate corresponding temperature-compensated reference voltages $V_P$ and $V_{P2}$, which can be adjusted or tuned to desired levels by selecting appropriate resistance values for resistive devices 206, 208, 210, 212 and 214. A more detailed discussion of how the first sub-circuit 20 generates temperature compensated voltages $V_P$ and $V_{P2}$, in accordance with one embodiment, is provided below.

The temperature-compensated voltages $V_P$ and $V_{P2}$ are provided as input voltages to the second sub-circuit 22. In one embodiment, the second sub-circuit 22 generally functions as a buffer amplifier that provides electrical impedance transformation between the first sub-circuit 20 and the third sub-circuit 24. Generally, the second differential amplifier 230 receives $V_{P2}$ at its positive input, with its negative input tied to its output. Thus, one purpose of the second differential amplifier 230 is to provide a voltage buffer for sensing $V_{P2}$ and outputting a corresponding reference voltage $V_{REF1}$. Similarly, the third differential amplifier 232 receives $V_P$ at its positive input, with its negative input tied to its output, as shown in FIG. 1. Thus, one purpose of the third differential amplifier 232 is to provide a voltage buffer for sensing $V_P$ and outputting a corresponding reference voltage $V_{REF2}$.

The third sub-circuit 24 receives reference voltages $V_{REF1}$ and $V_{REF2}$ from the second sub-circuit 22 and generally functions as a swing-buffer circuit to sense $V_{REF1}$ and $V_{REF2}$ and output a desired bandgap reference voltage $V_{REF}$. As shown in FIG. 1, $V_{REF1}$ is provided to a first terminal of resistive device 216. Resistive devices 216 and 220 adjust the value of $V_{REF1}$ to a desired level, which is then provided to a positive input of the fourth differential amplifier 234, as shown in FIG. 1. Similarly, $V_{REF2}$ is provided to a first terminal of resistive device 218. Resistive devices 218 and 222 adjust the value of $V_{REF2}$ to a desired level, which is then provided to a negative input of the fourth differential amplifier 234. By adjusting the resistance ratios of resistive devices 216, 218, 220 and 222 the third sub-circuit 24 can fine tune the output of the fourth differential amplifier 234 to provide a desired bandgap reference voltage $V_{REF}$.

A more detailed discussion of each of the components and operation of the bandgap reference circuit 200, in accordance with one embodiment, is provided below.

In one embodiment, the bandgap reference voltage circuit 200 includes two bipolar transistors 202 and 204, as shown in FIG. 1. In this embodiment, the two bipolar transistors 202 and 204 are PNP bipolar transistors having their base terminals coupled to ground and their collector terminals also coupled to ground. The emitter of the first PNP bipolar transistor 202 is coupled to a first terminal of resistive device 206 and the emitter of the second PNP bipolar transistor 204 is coupled to a first terminal of the resistive device 208. A second terminal of the resistive device 206 is coupled to a first terminal of resistive device 210 and a second terminal of resistive device 210 is coupled to a drain terminal of the first MOSFET transistor 224. A second terminal of resistive device 208 is coupled to a drain terminal of the second MOSFET transistor 226.

In an embodiment, the first and second MOSFET transistors 224 and 226 are PMOS transistors having their sources coupled to a voltage source $V_{DD}$. The gate terminals of the PMOS transistors 224 and 226 are both coupled to an output of a differential amplifier 228. A first terminal of resistive device 212 is coupled to ground while a second terminal of resistive device 212 is coupled to a positive input terminal of the differential amplifier 228. The second terminal of resistive device 206 is also coupled to the second terminal of resistive device 212 and the positive input terminal of the differential amplifier 228. A first terminal of resistive device 214 is coupled to ground while a second terminal of resistive device 214 is coupled to a negative input terminal of the differential amplifier 228 and the first terminal of resistive device 208. The differential amplifier 228 senses the voltage difference between its positive and negative terminals and outputs a regulated voltage to control the PMOS transistors 224 and 226.

In an embodiment, a bandgap reference circuit generates one or more temperature-compensated voltages (e.g., $V_P$ and $V_{P2}$ in FIG. 1), as discussed in further detail below. Referring to FIG. 1, for example, the voltage drop across the base-emitter junction, Vbe, of the bipolar junction transistors 202 and 204 changes in a Complementary-to-Absolute-Temperature (CTAT) fashion. Whereas if the two bipolar transistors 202 and 204 operate with unequal emitter current densities, for example, due to the extra resistive device 206 coupled between the emitter of the transistor 202 and resistive device 210, then the difference in the base-emitter voltages, ΔVbe, between the transistors 202 and 204 changes in a Proportional-To-Absolute-Temperature (PTAT) fashion. The PTAT relationship is given by $\Delta Vbe=V_T(\ln(n))$, where $V_T=kT/q$, k is Boltzmann's constant, T is the absolute temperature, q is the electron charge and n is the ratio of the current densities of the two bipolar transistors 202 and 204. The PTAT voltage (i.e., the difference in the base-emitter voltages, ΔVbe, between transistors 202 and 204) may be added to the CTAT voltage (i.e., the voltage drop across the base-emitter junction, Vbe, of the bipolar junction transistors 202 and 204) with suitable weighting constants to obtain a constant reference voltage.

During operation, the voltage at the positive terminal of differential amplifier 228 will reach a higher level than the voltage at the negative input terminal due to the resistive device 206. This allows the differential amplifier 228 to output a regulated signal at its output that will turn on the PMOS transistors 224 and 226. The feedback loop consisting of a differential amplifier 228 and the PMOS transistors 224 and 226 coupled with the voltage source, $V_{DD}$, forces the voltages at the positive and negative input terminals of the differential amplifier 228 to be equal. Consequently the current through the resistive device 212 ($I_2$) is proportional to the base-emitter junction voltage, Vbe, of the transistors 202 and 204 and the current through the resistive device 206 ($I_1$) is proportional to the difference of the two base-emitter junction voltages of the transistors 202 and 204 (ΔVbe). Setting the resistive device 212 equal to resistive device 214 makes their currents the same. Since the current flowing through the PMOS 224 is the sum of currents through resistive devices 206 and 212 ($I_1+I_2$), it will be proportional to $Vbe+\alpha\Delta Vbe$, which provides a substantially temperature independent reference. This is based on the fact that the two terms in the sum (Vbe and ΔVbe) have temperature coefficients of different sign and thus by adjusting the multiplication constant α, they can be made to cancel each other. Thus, the sum of the currents through resistive devices 206 and 212 ($I_1+I_2$), which equals the current through resistive device 210, are temperature compensated currents that generate temperature-compensated voltages $V_P$ and $V_{P2}$, as discussed further below.

As the voltage levels change at both the positive and negative terminals of the differential amplifier 228 during the operation of the bandgap reference circuit 200, the differential amplifier 228 will continue to sense the voltage difference between the two input terminals to provide a regulated signal at its output to control the PMOS transistors 224 and 226, thereby further adjusting the level of current ($I_1+I_2$) across resistive devices 206, 210 and 212, which sets the voltage ($V_P$) at the positive input terminal of the differential amplifier 228, and the level of current across resistive devices 208 and 214, which sets the voltage at the negative terminal of the differential amplifier 228. As showin in FIG. 1, the voltage $V_{P2}$ at the drain terminal of the PMOS transistor 224 also depends on the value of the sum of the currents ($I_1+I_2$) through resistive devices 206, 210 and 212. Thus, $V_P$ and $V_{P2}$ constitute temperature-compensated voltages because their value depends on the value of the temperature-compensated current sum ($I_1+I_2$). These temperature-compensated reference voltages are then provide to the second sub-circuit 22, as described below.

Instead of having the output of the differential amplifier 228 coupled to a gate of a third PMOS transistor of a current mirror as in another approach, for example, the bandgap circuit of FIG. 1 couples the drain terminal of PMOS transistor 224 (and hence $V_{P2}$) to a positive input terminal of a second differential amplifier 230. Additionally, the positive input terminal of the first differential amplifier 228 (and hence $V_P$) is coupled to a positive input terminal of a third differential amplifier 232.

The output of the second differential amplifier 230 is fed back to a negative input terminal of the amplifier 230 and outputs a first circuit reference voltage shown in FIG. 1 as $V_{REF1}$. The output of the third differential amplifier 232 is fed back to a negative input terminal of the amplifier 232 and outputs a second circuit reference voltage shown in FIG. 1 as $V_{REF2}$. The outputs, $V_{REF1}$ and $V_{REF2}$, of the second and third differential amplifiers 230 and 232, respectively, are then provided to the positive and negative inputs of a fourth differential amplifier 234 through two respective serial resistive devices 216 and 218, as shown in FIG. 1. A first terminal of a resistive device 220 is coupled to the supply voltage VDD while a second terminal of the resistive device 220 is coupled to the positive terminal of the fourth differential amplifier 234. A first terminal of a resistive device 222 is coupled to an output of the fourth differential amplifier 234 while a second terminal of the resistive device 222 is coupled to the negative input terminal of the fourth differential amplifier 234. Thus, the output of the fourth differential amplifier 234 is fed back to the negative input terminal of the amplifier 234 through serial resistive device 222.

The output of the fourth differential amplifier 234 is the bandgap reference voltage ($V_{REF}$) provided by the bandgap reference circuit shown in FIG. 1, in accordance with an embodiment. Based on the circuit described above and illustrated in FIG. 1, a bandgap function in accordance with one embodiment can be expressed by the following equations:

$$\begin{aligned}
V_{ref} &= \frac{R_9}{R_7}(V_{ref2} - V_{ref1} + V_{os3}) \\
&= \frac{R_9}{R_7}(V_{P2} + V_{os2} - (V_P + V_{os1}) + V_{os3}) \\
&= \frac{R_9}{R_7}(V_{P2} - V_P) + \frac{R_9}{R_7}(V_{os2} - V_{os1} + V_{os3}) \\
&= \frac{R_9}{R_7}[(V_{opp} + I_T * R_5) - V_{opp}] + \frac{R_9}{R_7}(V_{os2} - V_{os1} + V_{os3}) \\
&= \frac{R_9}{R_7}R_5\left[(I_1 + I_3) + \frac{V_{os4}}{R_1} + \frac{V_{os4}}{R_3}\right] + \frac{R_9}{R_7}(V_{os2} - V_{os1} + V_{os3}) \\
&= \frac{R_9}{R_7}\frac{R_5}{R_1}\left[V_{EB2} + \frac{R_1}{R_3}(V_T \ln n)\right] + \\
&\quad \frac{R_9}{R_7}(V_{os2} - V_{os1} + V_{os3}) + \frac{R_9}{R_7}\left(\frac{R_5}{R_1} + \frac{R_5}{R_3}\right)V_{os4}
\end{aligned}$$

where $R_1$ corresponds to the resistance value of resistive device 212, $R_2$ corresponds to the resistance value of resistive device 214, $R_3$ corresponds to the resistance value of resistive device 206, $R_5$ corresponds to the resistance value of resistive device 210, $R_6$ corresponds to the resistance value of resistive device 208, $R_7$ corresponds to the resistance value of resistive device 216, $R_8$ corresponds to the resistance value of resistive device 218, $R_9$ corresponds to the resistance value of resistive device 220, $V_{REF1}$ is the output of the second differential amplifier 230, $V_{REF2}$ is the output of the third differential amplifier 232, $V_{OS1}$ is the difference in input voltages at the positive and negative terminals of the second differential amplifier 230, $V_{OS2}$ is the difference in input voltages at the positive and negative terminals of the third differential amplifier 232, $V_{OS3}$ is the difference in input voltages at the positive and negative terminals of the fourth differential amplifier 234, $V_{OS4}$ is the difference in input voltages at the positive and negative terminals of the first differential amplifier 228, $V_P$ is the input voltage at the positive input terminal of the third differential amplifier 232, $V_{P2}$ is the input voltage at the positive input terminal of the second differential amplifier 230, $V_{EB2}$ is the base-emitter voltage of PNP transistor 204, and $V_T(\ln(n))$ was defined above.

In an embodiment, the following resistive device values can be used: $R_1$=$R_2$=6 KOhms; $R_3$=1 K Ohm; $R_5$=$R_6$=60 K Ohms; $R_7$=$R_8$=2 K Ohms; and $R_9$=40 K Ohms. If $V_{REF}$ is set to be equal to 0.6 volts, and $V_{OS4}$ is set to be 1 mV, the total error in $V_{REF}$ is equal to approximately 3.5 mV, which leads to approximately a 0.49% accuracy range based on Monte Carlo computer simulations.

Thus, the exemplary bandgap circuit described above and illustrated in FIG. 1 greatly increases the accuracy of a reference voltage when compared to other bandgap reference circuits. As shown in the table provided in FIG. 2, over a temperature range of −25 to 125 degrees Celsius, with a supply voltage of 1.8 volts, the standard variation of the VREF accuracy of the bandgap circuit in accordance with an embodiment of the disclosure when compared to another bandgap reference circuit improved from 2.10% to 0.80% accuracy. The standard variation of the temperature coefficient (TCF) improved from 30 ppm to 10 ppm ($10^{-6}$). While current load increased from 300 uA to 600 uA.

Figure 3:
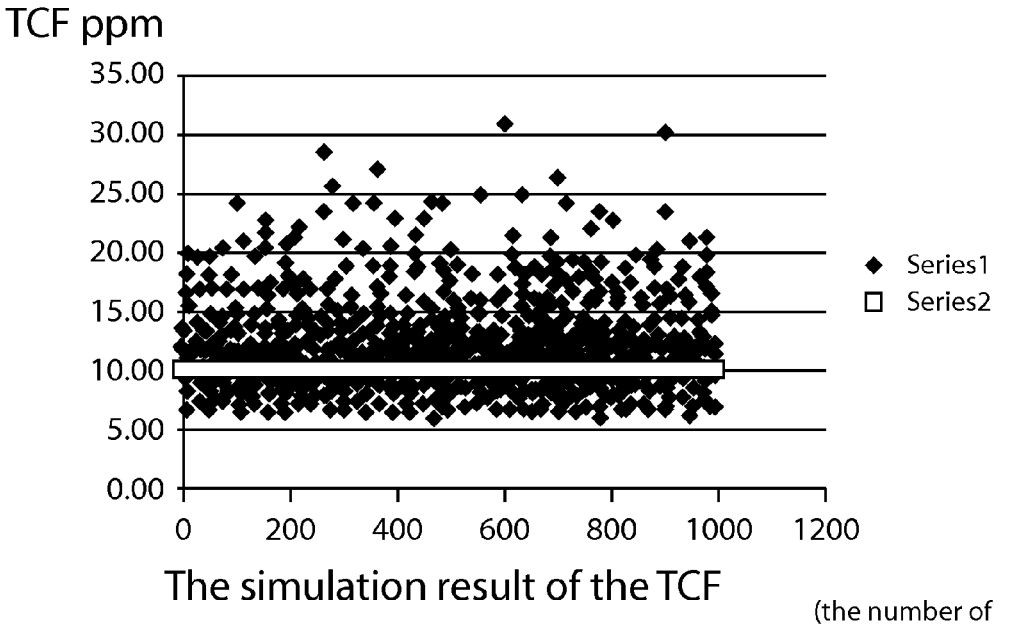
FIG. 3 illustrates a graph plot showing temperature coefficient (TCF) ppm vs. the number of Monte Carlo computer simulations performed on another bandgap circuit (series 1) compared to an exemplary bandgap circuit of the present disclosure (series 2).

FIG. 3 illustrates a plot diagram of the standard variation of the temperature coefficient (TCF) of another bandgap reference circuit (series 1) and that of the bandgap reference circuit of FIG. 1 (series 2) as a function of increasing numbers of Monte Carlo computer simulations of the circuits. As shown in FIG. 3, all the TCF values for series 2 fall approximately at 10.00 ppm with little variance between values. In contrast, the TCF values for series 1 range from approximately 6.00 ppm to as high as 30.00 ppm. Thus, the TCF of the bandgap circuit of FIG. 1 (series 2) is significantly more stable and accurate than that of other bandgap reference circuits (series 1).

Figure 4:
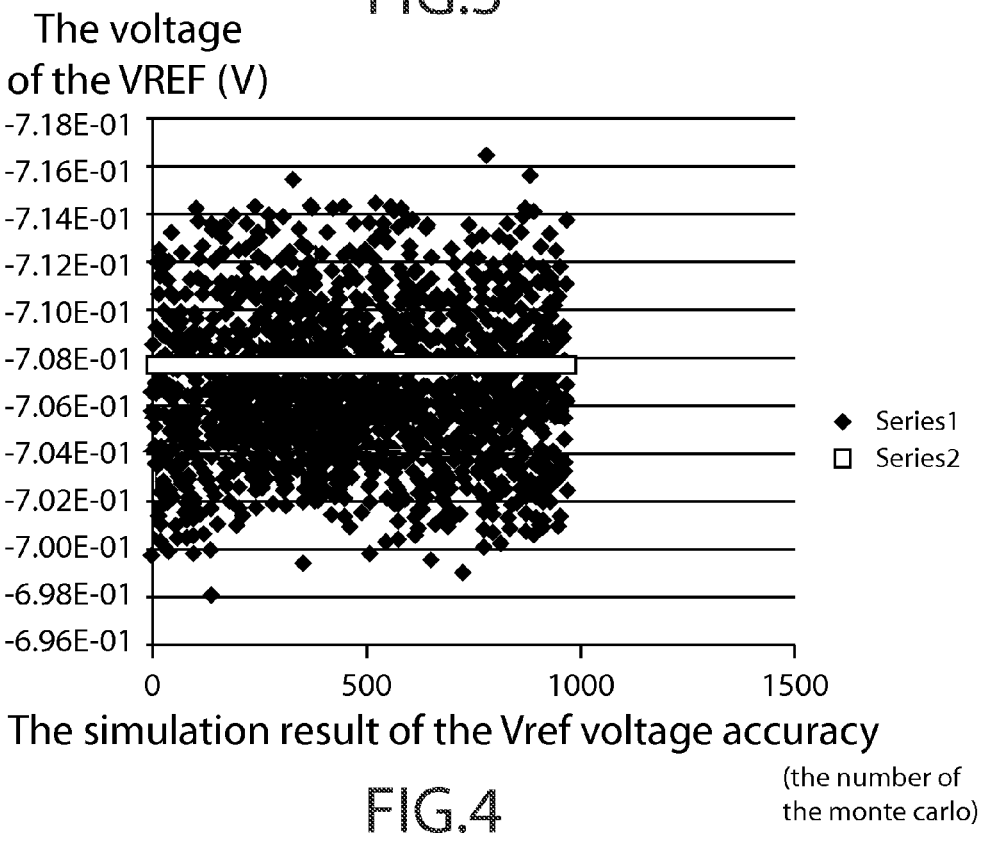
FIG. 4 illustrates a graph plot showing Vref vs. the number of Monte Carlo computer simulations performed on another bandgap circuit (series 1) compared to an exemplary bandgap circuit of the present disclosure (series 2).

FIG. 4 illustrates a plot diagram of the standard variation of the accuracy of the reference output voltage ($V_{REF}$) of another bandgap reference circuit (series 1) and that of the bandgap reference circuit of FIG. 1 (series 2) as a function of increasing numbers of Monte Carlo computer simulations of the circuits. As shown in FIG. 4, the $V_{REF}$ standard variation of the bandgap circuit of FIG. 1 (series 2) is relatively constant at −7.08E-01, while the standard variation of another bandgap circuit had a much larger range between −6.98E-01 to −7.16E-01. Thus, the $V_{REF}$ standard variation of the bandgap circuit of FIG. 1 (series 2) is significantly more stable and accurate than that of other bandgap reference circuits.

While at least an exemplary embodiment has been presented in the foregoing detailed description, it should be appreciated that many variations are possible. It should also be appreciated that the exemplary embodiment or exemplary embodiments are only examples, and are not intended to limit the scope, applicability, or configuration of the disclosure in any way. Rather, the foregoing detailed description will provide those of ordinary skill in the art with an enabling description and guidance for implementing the exemplary embodiment or exemplary embodiments. It should be understood that various changes can be made in the function and arrangement of elements without departing from the scope of the disclosure. For example, various types of reference voltage circuits may be made in accordance with the principles described in the present disclosure. Thus, the breadth and scope of the invention should not be limited by any of the above-described exemplary embodiments but, rather, be accorded a scope consistent with the claims presented below.

What is claimed is:

1. A reference circuit, comprising:

a first sub-circuit for generating first and second temperature-compensated voltages;

a second sub-circuit configured to receive the first and second temperature-compensated voltages and generate first and second reference voltages based on the first and second temperature-compensated voltages, respectively;

a third sub-circuit configured to receive and change voltage levels of the first and second reference voltages, and output a third reference voltage, wherein an output impedance of the first sub-circuit is higher than an input impedance of the third sub-circuit and the second sub-circuit provides a voltage buffer between the first and third sub-circuits;

wherein a first drain terminal of a first MOSFET transistor of the first sub-circuit is coupled to a positive input terminal of a second differential amplifier of the second sub-circuit and a positive input terminal of a first differential amplifier of the first sub-circuit is coupled to a positive input terminal of a third differential amplifier of the second sub-circuit, respectively, and wherein a standard variation of the third reference voltage over a temperature range of −25 to 125 degrees Celsius is less than 1.0%.

2. The reference circuit of claim 1 wherein the first sub-circuit comprises:

a first differential amplifier comprising first and second input terminals and a first output terminal;

the first MOSFET transistor comprising a first gate terminal coupled to the first output terminal of the first differential amplifier, a first source terminal coupled to a voltage source, and the first drain terminal coupled to the first input terminal;

a second MOSFET transistor comprising a second gate terminal coupled to the first output terminal of the first differential amplifier, a second source terminal coupled to the voltage source, and a second drain terminal coupled to the second input terminal;

a first bipolar transistor having a first emitter terminal coupled to the first input terminal, a first base terminal coupled to a ground of the reference circuit and a first collector terminal coupled to the ground; and a second bipolar transistor having a second emitter terminal coupled to the second input terminal, a second base terminal coupled to the ground and a second collector terminal coupled to the ground.

3. The reference circuit of claim 2 wherein a voltage present at the first drain terminal and a voltage present at the first input terminal are provided as the first and second temperature-compensated voltages to respective inputs of the second sub-circuit.

4. The reference circuit of claim 2 wherein the second sub-circuit comprises:

the second differential amplifier comprising a third input terminal coupled to the first drain terminal, a fourth input terminal and a second output terminal coupled to the fourth input terminal, wherein the second output terminal is configured to provide the first reference voltage; and the third differential amplifier comprising a fifth input terminal coupled to the first input terminal of the first differential amplifier, a sixth input terminal and a third output terminal coupled to the sixth input terminal, wherein the third output terminal is configured to provide the second reference voltage.

5. The reference circuit of claim 4 wherein the third sub-circuit comprises:

a fourth differential amplifier comprising a seventh input terminal coupled to the second output terminal of the second differential amplifier, an eighth input terminal coupled to the third output terminal of the third differential amplifier, and a fourth output terminal coupled to the eighth input terminal, wherein the fourth output terminal is configured to output the desired bandgap reference voltage.

6. The reference circuit of claim 5, further comprising:

a first resistive device serially connected between the first drain terminal of the first MOSFET transistor and the first input terminal of the first differential amplifier;

a second resistive device serially connected between second drain terminal and the second input terminal;

a third resistive device serially connection between the first emitter terminal and the first input terminal;

a fourth resistive device serially connected between the ground and the first input terminal; and a fifth resistive device serially connected between the ground and the second input terminal.

7. The reference circuit of claim 6, further comprising:

a sixth resistive device serially connected between the second output terminal and the seventh input terminal;

a seventh resistive device serially connected between the third output terminal and the eighth input terminal;

an eighth resistive device serially connected between the voltage source and the seventh input terminal; and a ninth resistive device serially connected between the eighth input terminal and the fourth output terminal.

8. A reference circuit, comprising:

a first differential amplifier comprising first and second input terminals and a first output terminal;

a first transistor comprising a first gate terminal coupled to the first output terminal of the first differential amplifier, a first source terminal coupled to a voltage source, and a first drain terminal coupled to the first input terminal;

a second transistor comprising a second gate terminal coupled to the first output terminal of the first differential amplifier, a second source terminal coupled to the voltage source, and a second drain terminal coupled to the second input terminal;

a second differential amplifier comprising a third input terminal coupled to the first drain terminal, a fourth input terminal and a second output terminal coupled to the fourth input terminal, wherein the second output terminal is configured to provide a first reference voltage;

a third differential amplifier comprising a fifth input terminal coupled to the first input terminal of the first differential amplifier, a sixth input terminal and a third output terminal coupled to the sixth input terminal, wherein the third output terminal is configured to provide a second reference voltage;

a fourth differential amplifier comprising a seventh input terminal coupled to the second output terminal of the second differential amplifier, an eighth input terminal coupled to the third output terminal of the third differential amplifier, and a fourth output terminal coupled to the eighth input terminal, wherein the fourth output terminal is configured to output a third reference voltage;

wherein the first drain terminal is coupled to a positive input terminal of the second differential amplifier and a positive input terminal of the first differential amplifier is coupled to a positive input terminal of the third differential amplifier, respectively, and wherein a standard variation of the third reference voltage over a temperature range of −25 to 125 degrees Celsius is less than 1.0%.

9. The reference circuit of claim 8 further comprising:

a first bipolar transistor having a first emitter terminal coupled to the first input terminal, a first base terminal coupled to a ground of the reference circuit and a first collector terminal coupled to the ground; and a second bipolar transistor having a second emitter terminal coupled to the second input terminal, a second base terminal coupled to the ground and a second collector terminal coupled to the ground.

10. The reference circuit of claim 9, further comprising:

a first resistive device having a first terminal coupled to the first drain terminal of the first MOSFET transistor and a second terminal coupled to the first input terminal of the first differential amplifier;

a second resistive device serially connected between second drain terminal and the second input terminal;

a third resistive device serially connection between the first emitter terminal and the first input terminal;

a fourth resistive device serially connected between the ground and the first input terminal; and a fifth resistive device serially connected between the ground and the second input terminal.

11. The circuit of claim 10 further comprising;

a sixth resistive device serially connected between the second output terminal and the seventh input terminal;

a seventh resistive device serially connected between the third output terminal and the eighth input terminal;

an eighth resistive device serially connected between the voltage source and the seventh input terminal; and a ninth resistive device serially connected between the eighth input terminal and the fourth output terminal.

12. A method of manufacturing a reference circuit, comprising:

providing a first sub-circuit for generating first and second temperature-compensated voltages;

coupling a second sub-circuit to the first sub-circuit, the second sub-circuit configured to receive the first and second temperature-compensated voltages and generate first and second reference voltages based on the first and second temperature-compensated voltages, respectively; and coupling a third sub-circuit to the second sub-circuit, the third sub-circuit configured to receive and change voltage levels of the first and second reference voltages to provide a third reference voltage, wherein an output impedance of the first sub-circuit is higher than an input impedance of the third sub-circuit and the second sub-circuit is configured to provide a voltage buffer between the first and third sub-circuits, wherein the first drain terminal is coupled to a positive input terminal of the second differential amplifier and a positive input terminal of the first differential amplifier is coupled to a positive input terminal of the third differential amplifier, respectively, and wherein a standard variation of the third reference voltage over a temperature range of −25 to 125 degrees Celsius is less than 1.0%.

13. The method of claim 12 wherein providing the first sub-circuit comprises:

providing a first differential amplifier comprising first and second input terminals and a first output terminal;

coupling a first transistor to the first differential amplifier, the first comprising a first gate terminal coupled to the first output terminal of the first differential amplifier, a first source terminal coupled to a voltage source, and a first drain terminal coupled to the first input terminal;

coupling a second transistor to the first differential amplifier, the second transistor comprising a second gate terminal coupled to the first output terminal of the first differential amplifier, a second source terminal coupled to the voltage source, and a second drain terminal coupled to the second input terminal;

coupling a first bipolar transistor to the first differential amplifier, the first bipolar transistor comprising a first emitter terminal coupled to the first input terminal, a first base terminal coupled to a ground of the reference circuit and a first collector terminal coupled to the ground; and coupling a second bipolar transistor to the first differential amplifier, the second bipolar transistor comprising a second emitter terminal coupled to the second input terminal, a second base terminal coupled to the ground and a second collector terminal coupled to the ground.

14. The method of claim 13 wherein the coupling of the second sub-circuit to the first sub-circuit comprises coupling the first drain terminal to a third input of the second sub-circuit and coupling the first input terminal to a fourth input of the second sub-circuit.

15. The method of claim 13 wherein coupling the second sub-circuit to the first sub-circuit comprises:

coupling a second differential amplifier to the first sub-circuit, the second differential amplifier comprising a third input terminal coupled to the first drain terminal, a fourth input terminal and a second output terminal coupled to the fourth input terminal, wherein the second output terminal is configured to provide a first reference voltage; and coupling a third differential amplifier to the first sub-circuit, the third differential amplifier comprising a fifth input terminal coupled to the first input terminal of the first differential amplifier, a sixth input terminal and a third output terminal coupled to the sixth input terminal, wherein the third output terminal is configured to provide a second reference voltage.

16. The method of claim 15 wherein coupling the third sub-circuit to the second sub-circuit, comprises:

coupling a fourth differential amplifier to the second sub-circuit, the fourth differential amplifier comprising a seventh input terminal coupled to the second output terminal of the second differential amplifier, an eighth input terminal coupled to the third output terminal of the third differential amplifier, and a fourth output terminal coupled to the eighth input terminal, wherein the fourth output terminal is configured to provide a third reference voltage.

17. The method of claim 16, further comprising:

providing a first resistive device serially connected between the first drain terminal of the first transistor and the first input terminal of the first differential amplifier;

providing a second resistive device serially connected between second drain terminal and the second input terminal; and providing a third resistive device serially connection between the first emitter terminal and the first input terminal.

18. The method of claim 17, further comprising:

providing a fourth resistive device serially connected between the ground and the first input terminal; and providing a fifth resistive device serially connected between the ground and the second input terminal.

19. The method of claim 18, further comprising:

providing a sixth resistive device serially connected between the second output terminal and the seventh input terminal; and providing a seventh resistive device serially connected between the third output terminal and the eighth input terminal.

20. The method of claim 19, further comprising:

providing an eighth resistive device serially connected between the voltage source and the seventh input terminal; and providing a ninth resistive device serially connected between the eighth input terminal and the fourth output terminal.

* * * * *